US008439522B2

(12) United States Patent
Kim

(10) Patent No.: US 8,439,522 B2
(45) Date of Patent: May 14, 2013

(54) ANGLE-ADJUSTING LED LIGHTING APPARATUS

(76) Inventor: Jong Chen Kim, Seoul (KR)

( * ) Notice: Subject to any disclaimer, the term of this patent is extended or adjusted under 35 U.S.C. 154(b) by 200 days.

(21) Appl. No.: 12/954,960

(22) Filed: Nov. 29, 2010

(65) Prior Publication Data

US 2011/0128737 A1 Jun. 2, 2011

(30) Foreign Application Priority Data

Nov. 30, 2009 (KR) ..... 20-2009-0015471 U

(51) Int. Cl.
*F21V 21/00* (2006.01)

(52) U.S. Cl.
USPC ..... 362/249.03

(58) Field of Classification Search . 362/249.01–249.03
See application file for complete search history.

(56) References Cited

U.S. PATENT DOCUMENTS

2009/0103293 A1* 4/2009 Harbers et al. ..... 362/231
2010/0284181 A1* 11/2010 O'Brien et al. ..... 362/235
2011/0141722 A1* 6/2011 Acampora et al. ..... 362/218

* cited by examiner

*Primary Examiner* — Anh Mai
*Assistant Examiner* — Hana Featherly
(74) *Attorney, Agent, or Firm* — NSIP Law

(57) ABSTRACT

An angle-adjusting LED lighting apparatus includes an LED light source on which LEDs and a printed circuit board electrically connected to the LEDs are mounted. A lens diffuses light illuminated from the LEDs, and a case houses the LED light source and the lens. At least one portion of an outer surface of the case is circular-shaped, an uneven part is formed at the circular-shaped outer surface of the case, and an engaging groove is formed inside the uneven part and penetrates the case along a length of the case. The apparatus includes an angle-adjustment member having an uneven surface that engages with the uneven part on one surface, and an engagement fixing member that engages with an outer fixing member on which the lighting apparatus is to be mounted using an engaging member. The engaging member penetrates the angle-adjustment member and is inserted into the engaging groove.

5 Claims, 5 Drawing Sheets

ANGLE-ADJUSTING LED LIGHTING APPARATUS

CROSS-REFERENCE TO RELATED APPLICATION(S)

This application claims the benefit under 35 U.S.C. §119 (a) of a Korean Patent Application No. 20-2009-0015471, filed on Nov. 30, 2009 in the Korean Intellectual Property Office, the entire disclosure of which is incorporated herein by reference for all purposes.

BACKGROUND

1. Field

The following description relates to an LED lighting apparatus, and in one particular, to an LED lighting apparatus by which the installation angle of the LED lighting apparatus is more easily adjustable and the assembling and disassembling for the angle adjustment can be carried out more easily.

2. Description of Related Art

LED (light emitting diode) is a light emitting element using a phenomenon that light generates when a current flows on a PN junction of compound semiconductors such as GaP, GaAs, etc., and it is widely being used since its reaction time is faster than general light bulbs and power consumption is as low as about 20% of an incandescent light bulb. Advantageously, the brightness is very high with relatively low power consumption.

Lighting apparatus using such LED is being used for a headlight of a car or an outdoor lighting apparatus, and the lighting apparatus is shown and suggested in FIG. 1.

Since light of LED has a good straightness, but a poor diffusivity, the installed angle of the lighting apparatus is adjusted when the illumination direction is desired to be changed.

As shown in FIG. 1, a conventional LED lighting apparatus is configured such that a case surrounds a LED light source, fixing elements such as bolts are provided in the case, and the fixing elements are fixed to a bracket, a plate or a pipe at the outer surface where the fixing elements are to be located. Therefore, when the angle of the lighting apparatus is desired to be adjusted, the location of the fixing elements such as bolts in the case should be adjusted after the lighting apparatus is released from the outer bracket and then the case is removed, which makes the assembling and disassembling for the angle adjustment difficult.

Moreover, a conventional LED lighting apparatus is configured such that the wires of the light source on which many LEDs are mounted are connected to the outer wires and then the connected portion is wrapped by insulating tapes, thereby the installation is very complex and the water-proof function may not be guaranteed.

SUMMARY

In one general aspect, there is provided an angle-adjusting LED lighting apparatus comprising: an LED light source on which a plurality of LEDs and a printed circuit board electrically connected to the LEDs are mounted, a lens that diffuses light illuminated from the LEDs, and a case that houses the LED light source and the lens, characterized in that at least one portion of the outer surface of the case is circular-shaped, an uneven part is formed at the circular-shaped outer surface of the case, an engaging groove is formed inside the uneven part and is penetrating the case along the length of the case, and it further comprises an angle-adjustment member having an uneven surface that engages with the uneven part on one surface; and an engagement fixing member that engages with an outer fixing member on which the lighting apparatus is to be mounted by means of an engaging member penetrating the angle-adjustment member and that is inserted into the engaging groove.

Here, the engaging groove and the engagement fixing member may have semi-circular sections, and the length of the engagement fixing member may be shorter than that of the engaging groove such that the engagement fixing member can be inserted into the engaging groove and be displaced to desired location along the engaging groove.

Here, the other surface of the angle adjustment member may have a circular groove that is recessed inward, and the apparatus may further comprise a frictional fixing member that is inserted into the circular groove and has a friction surface corresponding to the shape of the outer fixing member.

Here, the case may further comprise, on its side, a jack receiving part that is electrically connected to the LED light source and provides electric power to the LED light source by receiving an outer power supplying jack.

Other features and aspects will be apparent from the following detailed description, the drawings, and the claims.

Figure 1:
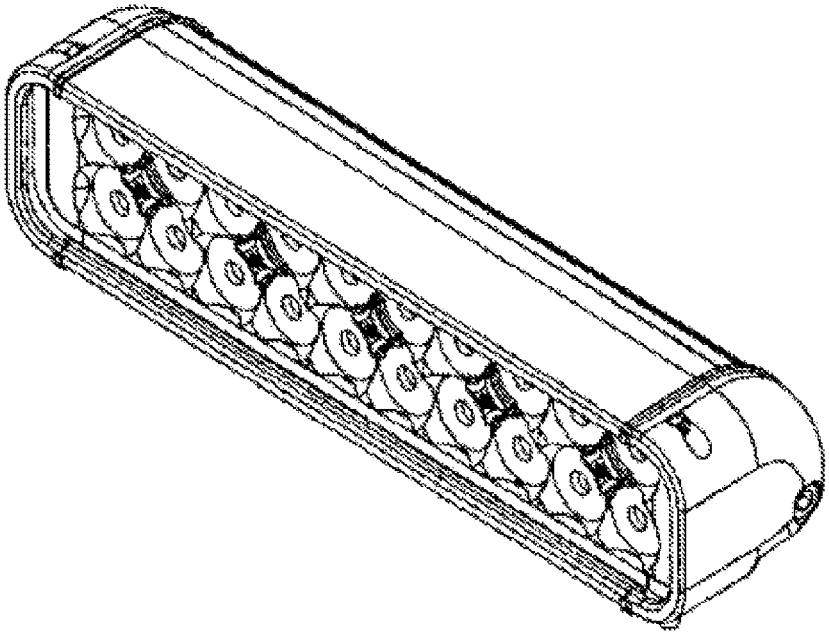
Fig. 1 (PRIOR ART)
FIG. 1 is a diagram illustrating a conventional LED lighting apparatus.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses, and/or systems described herein. Accordingly, various changes, modifications, and equivalents of the systems, apparatuses and/or methods described herein will be suggested to those of ordinary skill in the art. Also, descriptions of well-known functions and constructions may be omitted for increased clarity and conciseness.

Figure 2:
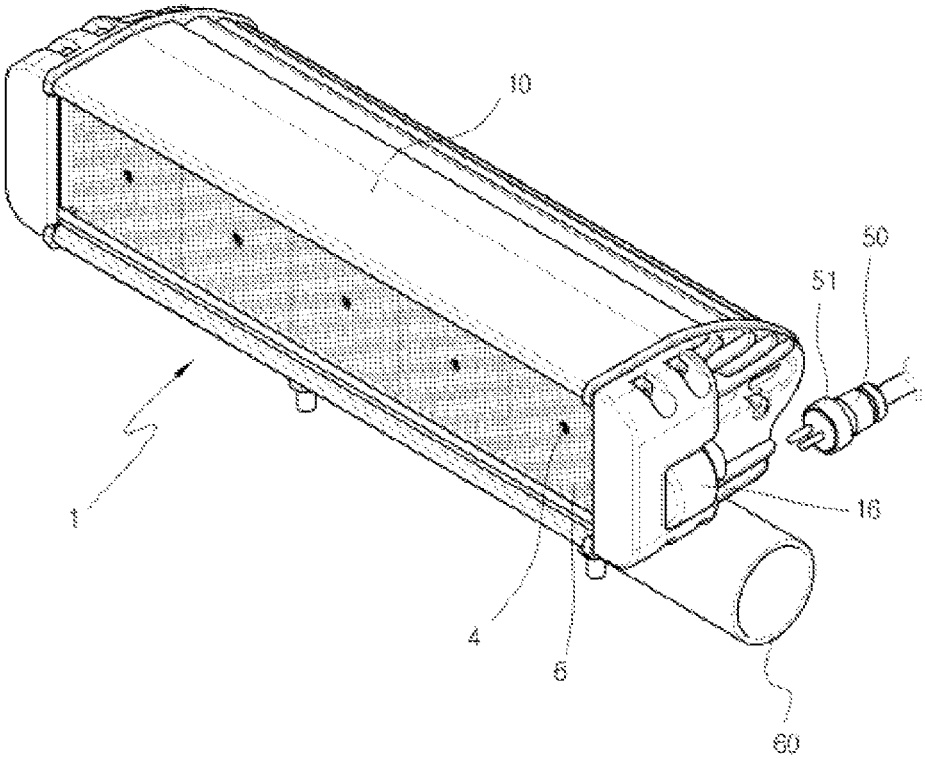
FIG. 2 is a diagram illustrating a perspective view of an LED lighting apparatus according to an example embodiment.
Figure 3:
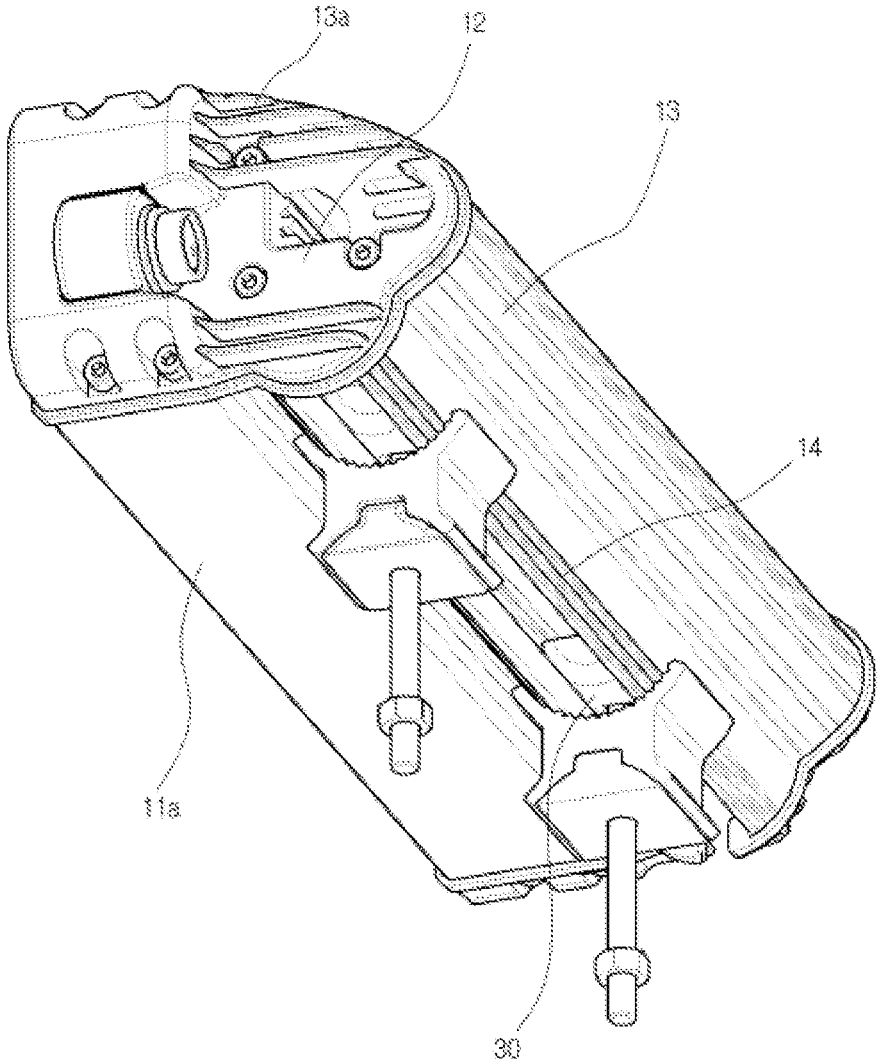
FIG. 3 is a diagram illustrating an angle adjustment part of the LED lighting apparatus according to an example embodiment.
Figure 4:
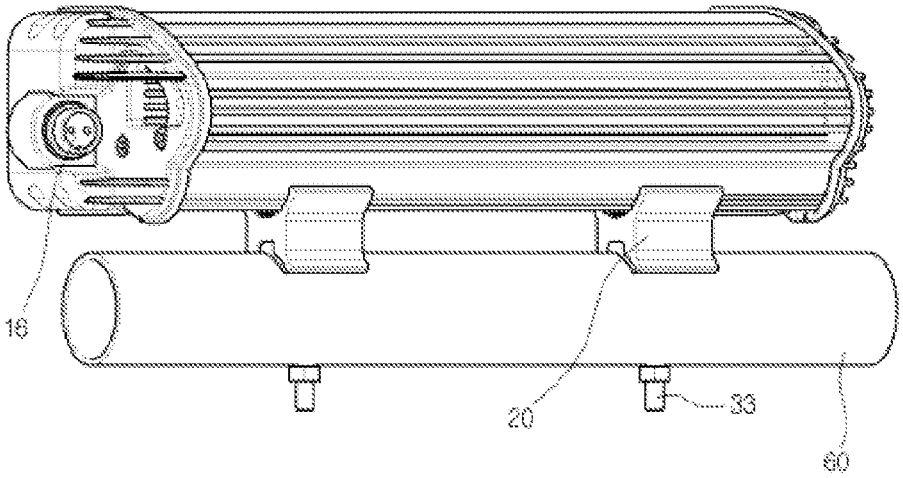
FIG. 4 is a diagram illustrating the engagement of the LED lighting apparatus with an outer fixing member according to an example embodiment.
Figure 5:
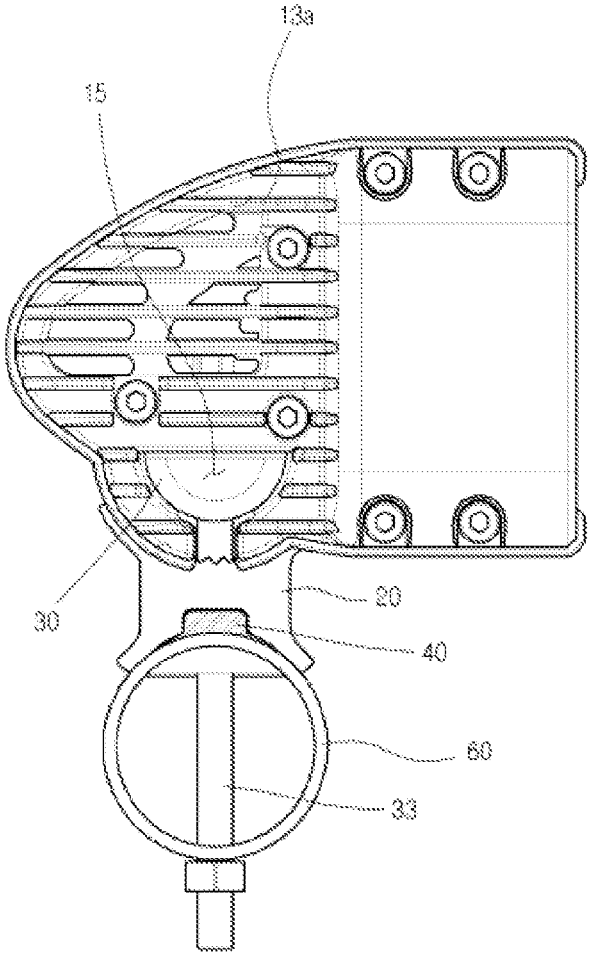
FIG. 5 is a diagram illustrating a side view of the LED lighting apparatus according to an example embodiment.
Figure 6:
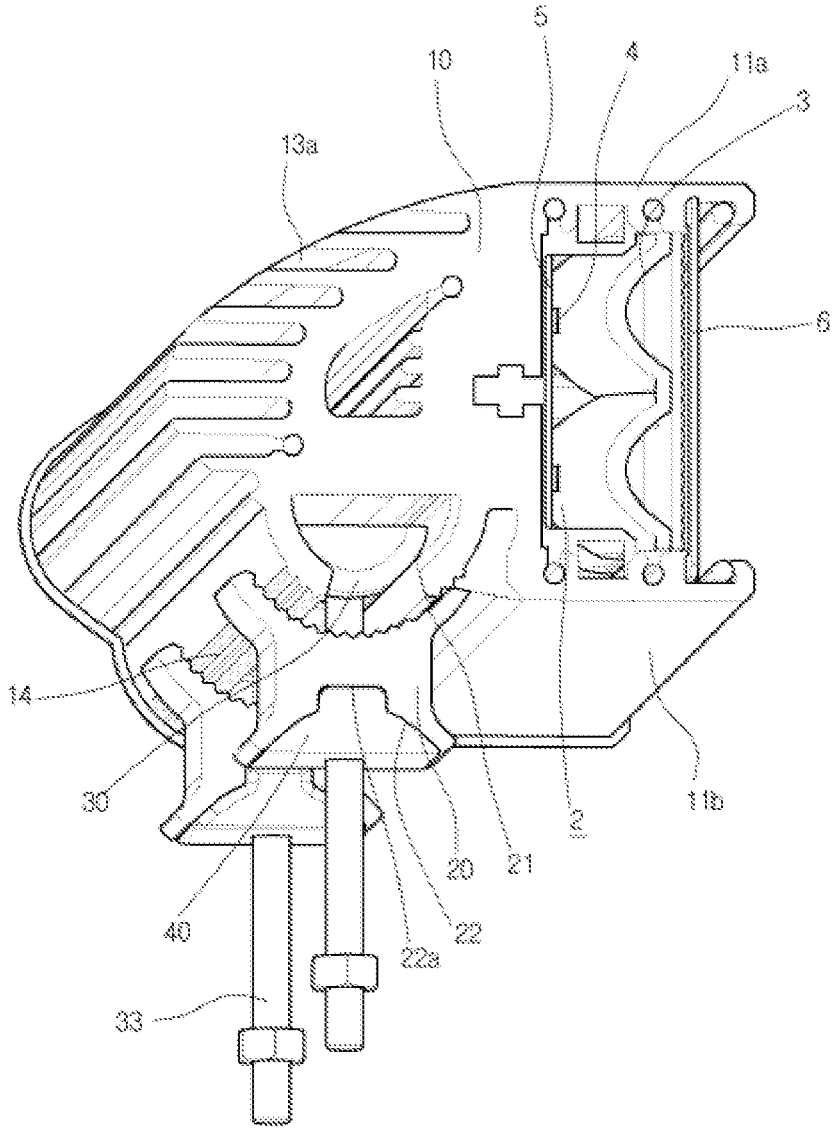
FIG. 6 is a diagram illustrating a side sectional view of the LED lighting apparatus according to an example embodiment.
Figure 7A:
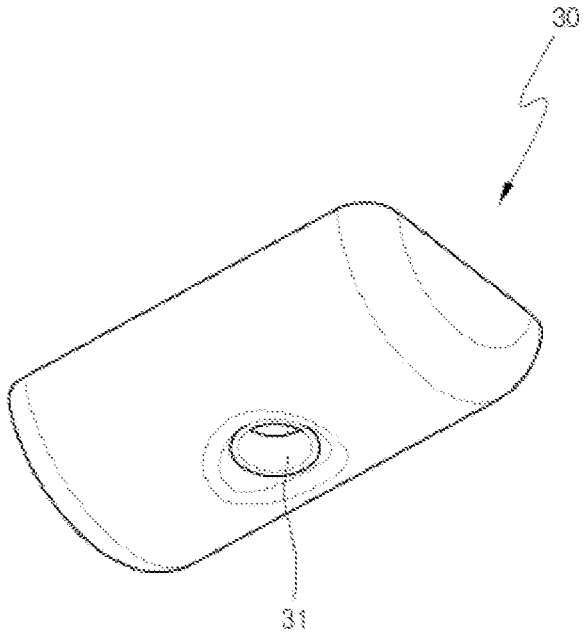
FIGS. 7A and 7B are diagrams illustrating an engagement fixing member of the LED lighting apparatus according to an example embodiment.
Figure 7B:
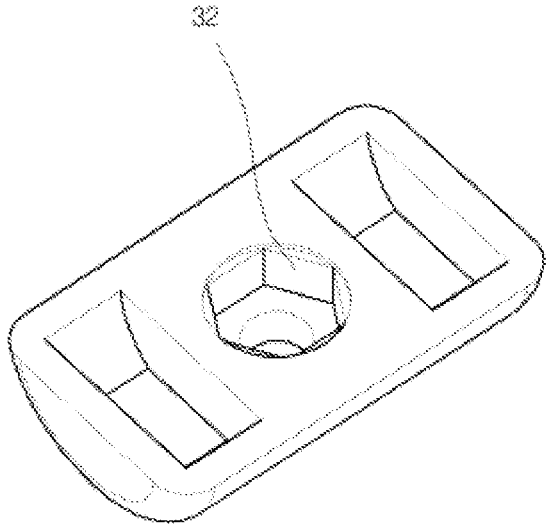

FIG. 2 shows a perspective view of an LED lighting apparatus according to an example embodiment, FIG. 3 shows an angle adjustment part of the LED lighting apparatus, FIG. 4 shows the engagement of the LED lighting apparatus with an outer fixing member, FIG. 5 shows a side view of the LED lighting apparatus, FIG. 6 shows a side sectional view of the LED lighting apparatus, FIGS. 7A and 7B show an engagement fixing member.

While an LED lighting apparatus using a lengthy rod-type lighting apparatus is shown, it is understood that this is only for illustrative propose and that the apparatus is not limited to the rod-type apparatus, but rather may be applied to lighting apparatus of various shapes.

As shown in FIGS. 2 to 7B, an angle-adjusting LED lighting apparatus (1) according to an example embodiment comprises an LED light source (2), a lens (3), a case (10), an angle adjustment member (20) and an engagement fixing member (30).

A plurality of LEDs (4) and a printed circuit board (5) electrically connected to the LEDs (4) are mounted on the LED light source (2).

The lens (3) receives light illuminated from the LED (4) and then diffuses it to the front, and may be dome-shaped to increase the diffusivity.

A radiation plate (6) is located in front of the lens (3) and the inner surface of the radiation plate (6), i.e., the surface facing the lens (3), has, for example, various patterns as well as uneven surface (prominence and depression) so as to increase the diffusion of the light diffusivity through the lens (3).

The case (10) houses the LED light source (2), the lens (3) and the radiation plate (6). In the example embodiment, the case (10) is configured such that an upper plate (11*a*), a lower plate (11*b*), a side plate (12) and a back plate (13) are integral with one another. For example, the back plate (13) is circular-shaped and the upper part of the back plate (13) has radiation plates (13*a*) so as to dissipate heat generated from the LED, and the radiation plates are integral with the circular-shaped part and are slitted.

The back plate (13) has an uneven part (14) under the radiation plate. The uneven part (14) is formed along the entire length of the back plate of the case. The prominence and depression of the uneven part (14) can be shaped as thread or gear teeth, and a cut-out part of the case is formed along the length at the middle part of the uneven part (14) so that an engaging member and an engagement fixing member are fixed through the cut-out part.

Also, the back plate (13) of the case (10) has an engaging groove (15) at the inner part of the uneven part (14) and the groove (15) penetrates the inner part in a length direction. At least one of the side plates (12) also has an engaging groove corresponding to the engaging groove (15) such that an engagement fixing member that will be described hereinafter can be inserted. For example, the engaging groove (15) has a semi-circular section.

An engagement fixing member (30) is inserted into the engaging groove (15). The engagement fixing member (30) has a semi-circular section in accordance with the shape of the engaging groove (15) and has a penetrating hole (31) at the center of the semi-circular part. The inner part of the penetrating hole (31) has an engaging hole (32) through which a head of the engaging member that will be described hereinafter is inserted.

The engaging member (33) can be of the shape of a lengthy rod having one end of a hexagon head bolt and the other end can be tightened to an outer fixing member (60) by means of a nut. The length of the engagement fixing member (30) is shorter than that of the engaging groove (15) such that the fixing member (30) can be inserted into the engaging groove and be moved to desired location along the groove.

Meanwhile, the uneven part of the case engages with an angle adjustment member (20). The surface of the angle adjustment member (20) facing the uneven part is circular-shaped to be in accordance with the circular shape of the back plate and the outer surface has an uneven surface (21). The prominence and depression of the uneven surface (21) corresponds to that of the uneven part (14).

At the center of the angle adjustment member (20), there is a lengthy and circular shaped penetrating hole through which the engaging member (33) is inserted. Also, the other surface of the angle adjustment member (20) may have a circular-shaped groove (22) that is concave inwardly.

A frictional fixing member (40) can be inserted into the groove (22). The frictional fixing member (40) can be made from elastic material such as rubber and one surface is formed to correspond to the circular-shape groove (22) and the other surface is formed to correspond to the shape of the outer fixing member (60). For example, the member (40) can have a plane surface as shown in FIG. 6 when the outer fixing member (60) has the plane shape, and it can have a circular shape as shown in FIG. 5 when the outer fixing member (6) has the pipe shape. The frictional fixing member being provided, the engagement of the outer fixing member with the lighting apparatus can be made more stable.

Furthermore, the middle portion of the groove (22) can have a deeper groove (22*a*) additionally, and the frictional fixing member can be shaped accordingly, thereby the engagement of the angle adjustment member (20) with the frictional fixing member can be made more stable.

The assembling, disassembling and angle adjustment of the example apparatus as described above will be further described below.

For example, the engaging member is inserted into the penetration hole of the engagement fixing member (30) and then the head of the engaging member is inserted into the engaging hole of the engagement fixing member (30). Then, the engagement fixing member (30) into which the engaging member is inserted is inserted at one side of the engaging groove (15) and is displaced to the desired position along the engaging groove.

Then, the engaging member is inserted into a lengthy circular penetration hole of the angle adjustment member (20) and the angle adjustment member (20) is moved by the desired angle. Then, the frictional fixing member is inserted into the circular groove (22) of the angle adjustment member while the engaging member is being inserted.

The engaging member is inserted into the outer fixing member (60) and then is tightened by the nut that is provided at the other side of the engaging member. In this case, the tightening may be controlled such that the uneven surface of the angle adjustment member (20) engages with the uneven surface of the case. Accordingly, installation of the LED lighting apparatus may more easily be completed.

Meanwhile, when the angle of the installed LED lighting apparatus is desired to be changed, the adjustment of the angle may be easily completed by loosening the nut, displacing the angle adjustment member (20) by the desired angle, then re-tightening the nut.

As described above, the angle adjustment of the LED lighting apparatus can be done easily, and the assembling and disassembling can be carried out simply.

Furthermore, a jack receiving part (16) can be further provided to one side of the case. The jack receiving part (16) is electrically connected to the LED light source, and a power supply jack (50) integral with the power supply wires is inserted into the jack receiving part (16). Also, a packing (51) is provided on the end of the power supply jack (50) so that the jack receiving part (16) is water-proof even when the LED lighting apparatus gets wet due to the rain. Therefore, the water-proof function as well as the electrical connection may be attained simply without complex work such as the connection of the wire of the light source on which many LEDs are mounted with the outer wires and then wrapping the connected part by taping as in a conventional LED lighting apparatus.

According to the example(s) described above, an LED lighting apparatus may be provided capable of easily adjusting the angle of the entire lighting apparatus without disassembling the case of the LED lighting apparatus, and in which performing assembling and disassembling for the angle adjustment can be more easily carried out.

According to the example(s) described above, an LED lighting apparatus LED may be provided capable of supplying power to the light source more simply.

As described above in one example, the angle of the LED lighting apparatus can be adjusted by disassembling the outer fixing member, the engaging member and the angle adjustment member, and displacing the angle adjustment member along the uneven surface of the case to control the angle, and then reassembling them.

Also, during the installation of the LED lighting apparatus, the installation can be completed by connecting the engaging member to the engagement fixing member, by inserting the engagement fixing member into the engaging groove of the case and locating it along the engaging groove, and then by engaging the angle adjustment member and the outer fixing member with the engaging member, thereby resulting in an easy installation as well as a fine position-adjustment of the installed LED lighting apparatus.

Further, power can be supplied to the LED lighting apparatus by simply inserting the power supplying jack into the jack receiving part.

A number of examples have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. An angle-adjusting LED lighting apparatus comprising:

an LED light source on which light emitting diodes (LEDs) and a printed circuit board electrically connected to the LEDs are mounted, wherein the LED light source comprises a lens configured to diffuse light illuminated from the LEDs, and a case configured to house the LED light source and the lens, at least one portion of the outer surface of the case is circular-shaped, an uneven part is formed at the circular-shaped outer surface of the case, an engaging groove is formed inside the uneven part and penetrates the case along the length of the case;

an angle-adjustment member comprising an uneven surface engaging with the uneven part on one surface; and an engagement fixing member configured to engage with an outer fixing member on which the lighting apparatus is to be mounted using an engaging member penetrating the angle-adjustment member and inserted into the engaging groove.

2. The apparatus according to claim 1, wherein the engaging groove and the engagement fixing member have semi-circular sections, and the length of the engagement fixing member is shorter than that of the engaging groove such that the engagement fixing member can be inserted into the engaging groove and be displaced to desired location along the engaging groove.

3. The apparatus according to claim 2, wherein the other surface of the angle adjustment member has a circular groove that is recessed inward, and the apparatus further comprises:

a frictional fixing member configured to be inserted into the circular groove and comprising a friction surface corresponding to the shape of the outer fixing member.

4. The apparatus according to claim 1, wherein the other surface of the angle adjustment member has a circular groove that is recessed inward, and the apparatus further comprises:

a frictional fixing member configured to be inserted into the circular groove and comprising a friction surface corresponding to the shape of the outer fixing member.

5. The apparatus according to claim 1, wherein the case further comprises, on its side, a jack receiving part that is electrically connected to the LED light source and provides electric power to the LED light source by receiving an outer power supplying jack.

* * * * *